US006640955B1

(12) United States Patent
Furuya

(10) Patent No.: US 6,640,955 B1
(45) Date of Patent: Nov. 4, 2003

(54) COIN INSPECTION METHOD AND DEVICE

(75) Inventor: Yonezo Furuya, Saitama (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 224 days.

(21) Appl. No.: 09/679,444

(22) Filed: Oct. 4, 2000

(30) Foreign Application Priority Data

Oct. 6, 1999 (JP) ..... 11/285666

(51) Int. Cl.[7] ..... G07D 5/00
(52) U.S. Cl. ..... 194/317; 194/319; 194/334
(58) Field of Search ..... 194/317, 318, 194/319, 334

(56) References Cited

U.S. PATENT DOCUMENTS

| | | | | | |
|---|---|---|---|---|---|
| 2,540,063 | A | * | 1/1951 | Victoreen | 194/318 |
| 3,506,103 | A | * | 4/1970 | Kuckens et al. | 194/318 |
| 4,660,705 | A | * | 4/1987 | Kai et al. | 194/318 |
| 5,056,644 | A | * | 10/1991 | Parker | 194/318 |
| 5,323,891 | A | * | 6/1994 | Waite | 194/318 |
| 5,458,225 | A | * | 10/1995 | Iwamoto et al. | 194/318 |
| 5,808,466 | A | * | 9/1998 | Ibarrola et al. | 194/318 |
| 6,098,777 | A | * | 8/2000 | Hoffman et al. | 194/318 |
| 6,325,197 | B1 | * | 12/2001 | Furuya | 194/318 |

FOREIGN PATENT DOCUMENTS

| | | |
|---|---|---|
| EP | 0392110 A2 | 8/1989 |
| JP | 4-311294 A | 4/1992 |
| JP | 5-54229 A | 3/1993 |
| JP | 7-272039 A | 10/1995 |
| JP | 8-161575 A | 6/1996 |
| JP | 53-9598 | 7/1996 |
| JP | 10-143703 A | 5/1998 |
| JP | 11-250305 A | 9/1999 |
| JP | 110250304 | 9/1999 |
| JP | 11-250305 | 6/2000 |
| JP | 2000268222 | 9/2000 |
| WO | WO 87/02809 | 10/1986 |
| WO | WO99/44176 A1 | 2/1998 |

OTHER PUBLICATIONS

A copy of Korean Office Action.

* cited by examiner

*Primary Examiner*—Kathy Matecki
*Assistant Examiner*—Thuy V. Tran
(74) *Attorney, Agent, or Firm*—Welsh & Katz, Ltd.

(57) ABSTRACT

A coin inspection method and device of inexpensive composition are provided, whereby the shape of the edge portions of a coin and the indentations patterns on the surface of a coin can be inspected with a high level of accuracy by means of a simple, single group of coils. Detecting coils generating a double-peak shaped magnetic field are formed by providing a first detecting coil and a second detecting coil respectively on two adjacent leg sections of a comb-shaped core, wherein a plurality of leg sections are disposed in approximately linear fashion at prescribed intervals, and the first detecting coil and the second detecting coil are excited in such a manner that the magnetic fluxes generated at the magnetic poles formed by the two leg sections repel with each other; a coin under inspection is caused to pass through the double-peak shaped magnetic field generated by the detecting coils; and the authenticity of the coin under inspection is identified on the basis of the changes in the impedance generated by the detecting coils during the passage of the coin under inspection.

21 Claims, 18 Drawing Sheets

PRIOR ART

COIN INSPECTION METHOD AND DEVICE

BACKGROUND OF THE INVENTION

1. Field of the Invention

This invention relates to a coin inspection method and device for inspecting the authenticity of coins, and more particularly, to a coin inspection method and device suitable for inspecting coins used in an automatic vending machine, game machine, or the like.

2. Description of the Related Art

In recent years, electronic coin inspection devices employing induction coils have been used commonly as coin inspection devices used in automatic vending machines, game machines, and the like.

Generally, a coin inspection device of this kind employs the gravitational fall of coins, and is constituted in such a manner that a plurality of groups of induction coils are disposed in a coin passage which guides coins inserted via a coin insertion slot, electromagnetic fields are created by exciting the plurality of induction coil groups by means of respectively different frequencies, and the authenticity of coins inserted via the coin insertion slot is inspected by means of the change in the electromagnetic fields caused by the passage of the coins through the electromagnetic fields.

The inspection of the coins by means of this coin inspection device is based on commonly known principles, whereby the authenticity of a coin is identified by detecting the quantities of electrical change (frequency change, voltage change, phase change) arising from the interaction between the electromagnetic field and the coil when the coin passes through the aforementioned electromagnetic field.

Conventionally, in a coin inspection device of this kind, the characteristics of the coins depend on frequency parameters, and therefore by using a plurality of frequencies, it is possible to achieve a technique for inspecting the material, outer diameter, thickness, and the like, of coins, as disclosed in U.S. Pat. No. 3,870,137.

Moreover, in recent years, coin inspection devices employing a technique for detecting the surface shape of a coin have been proposed, representative examples thereof being the devices disclosed in Japanese Patent Application Laid-open No. 11-167655 and Japanese Patent application Laid-open No. 11-175793.

Furthermore, the induction coils in a conventional coin inspection device employ a pot-shaped core or an E-shaped coil.

In recent years, with the process of internationalization, foreign coins have become readily available, and there have been an increasing number of cases where such coins are mistakenly inserted into an automatic vending machine, or the like, or where they are inserted thereinto illegally by people seeking to commit fraud, or the like.

Of these foreign coins, there are those which are similar to genuine valid coins, in terms of material, outer diameter, thickness, and the like. Alternatively, foreign coins which have been made to simulate genuine valid coins by modification, or the like, have become available in large number.

Of these foreign coins and the foreign coins which have been modified, there are those which, although having a different surface design (indentation pattern) or a different coin edge (flange) shape from the genuine coins, have approximately the same material properties, outer diameter and thickness as genuine coins, and hence in a conventional coin inspection device, such coins may be accepted mistakenly as genuine coins, in which case, the proprietor of the automatic vending machine, or the like, will suffer unlawful losses.

Therefore, a technique which detects the indentation pattern of the coin surface and the shape of the edge section (flange) thereof with a high degree of accuracy is desired.

FIG. 18 is a graph of the characteristics of an induction coil used in a conventional coin inspection device.

In a conventional coin inspection device, a device wherein a coil 182 is wound about a center leg section 181 of an E-shaped core 180, as illustrated in FIG. 18, is used.

Looking at the distribution of the electromagnetic field generated at the respective magnetic poles of the induction coils, as illustrated in FIG. 18, the magnetic poles in the central region display the greatest strength, whilst at the magnetic poles at either end, the electromagnetic field is reduced to a fraction thereof, and hence the electromagnetic field acting on the coins is a simple peak-shaped electromagnetic field.

If a simple peak-shaped electromagnetic field of this kind is used, it is not possible to concentrate the magnetic flux acting on the coins, and therefore the electromagnetic field acts over a wide area of the coin surface, detection is slow, and it has been difficult to detect detailed features of the shape of the coin surface.

Moreover, in order to detect detailed features of the shape of the coin surface, it has been attempted to adopt optical methods using image detecting elements (CCD) in a coin inspection device of this type, but dust or the like may adhere to the coins, impairing coin authenticity judgement, and furthermore the device becomes not only larger, but also more complicated, and as a result, the overall device becomes expensive.

SUMMARY OF THE INVENTION

Therefore, it is an object of the present invention to provide a coin inspection method and device whereby the shape of the edge section of a coin and the indentation pattern on the surface thereof can be inspected with a high degree of accuracy, by means of a simple single-group coil composition, which is moreover inexpensive. In order to achieve the aforementioned objects, the present invention provides a coin inspection method, comprising the steps of: forming detecting coils by providing a first detecting coil on one of two adjacent leg sections of a core having a plurality of leg sections and a second detecting coil on the other one of the leg section respectively; generating a double-peak shaped magnetic field by exciting the first and second detecting coils in such a manner that magnetic fluxes generated at magnetic poles formed by the leg sections repel each other; causing a coin under inspection to pass through the double-peak shaped magnetic field; and inspecting characteristics of the coin under inspection on the basis of changes in electrical properties of the detecting coils generated by the passage of the coin under inspection.

Here, the detecting coils allows the coin under inspection to pass through a direction coincide with a disposing direction of the first and second detecting coils of the core.

Furthermore, an inspection signal is created on the basis of changes in the electrical properties generated in the detecting coils, and features of edge portions of the coin under inspection are extracted on the basis of a signal waveform of the inspection signal when the waveform increases or declines.

Furthermore, an inspection signal is created on the basis of changes in electrical properties generated in the detecting coils, and features of a pattern of indentations on a surface of the coin under inspection are extracted on the basis of a signal in a maximum change region of the inspection signal.

Furthermore, the present invention provides a coin inspection method, comprising the steps of: disposing a first and second detecting coils, which are respectively provided with a first detecting coil on one of two adjacent leg sections of a core having a plurality of leg sections and a second detecting coil on the other one of the leg section, on either side of a coin passage along which a coin under inspection passes, the first and second detecting coils being connected serially in reverse phase in such a manner that a mutual inductance thereof is negative; generating a double-peak shaped magnetic field toward the coin passage from the first and second detecting coils; causing the coin under inspection to pass through the double-peak shaped magnetic field; and inspecting characteristics of the coin under inspection on the basis of changes in electrical properties of the detecting coils generated by the passage of the coin under inspection.

Furthermore, the present invention provides a coin inspection device for passing a coin under inspection through a magnetic field generated by detecting coils and determining authenticity of the coin under inspection on the basis of changes in electrical properties of the detecting coils, wherein the detecting coils comprise: a core having a plurality of leg sections;

a first detecting coil and a second detecting coil provided respectively at two adjacent leg sections of the core; and magnetic field generating means for generating a double-peak shaped magnetic field by exciting the first detecting coil and the second detecting coil in such a manner that magnetic fluxes generated at magnetic poles formed by the two leg sections repel with each other.

Here, the core is constituted such that a cross-sectional shape of the leg sections is a square shape, a circular shape, or an oval shape, and both ends thereof are arc-shaped.

Furthermore, the detecting coils are disposed in such a manner that a direction in which the first detecting coil and second detecting coil are disposed in the core coincides with a direction of passage of the coin under inspection.

Furthermore, the coin inspection device comprises an oscillating circuit containing the detecting coils as a resonance element.

Furthermore, the coin inspection device comprises inspection signal generating means for generating an inspection signal on the basis of changes in electrical properties generated in the detecting coils; and means for extracting features of edge portions of the coin under inspection on the basis of the inspection signal when it increases or declines.

Furthermore, the coin inspection device comprises inspection signal generating means for generating an inspection signal on the basis of changes in electrical properties generated in the detecting coils; and means for extracting features of a pattern of indentations on a surface of the coin under inspection on the basis of a signal in a maximum change region of the inspection signal.

Furthermore, the present invention provides a coin inspection device for passing a coin under inspection through a magnetic field generated by detecting coils and determining authenticity of the coin under inspection on the basis of changes in electrical properties of the detecting coils, wherein the detecting coils comprise: a first detecting coil disposed along a passage of the coin under inspection, and provided in a core having a plurality of leg sections which generates a first double-peak shape magnetic field toward the coin passage; and a second detecting coil disposed along the coin passage in such a manner as to oppose to the first detecting coil and provided on a core having a plurality of leg sections which generates a second double-peak shaped magnetic field toward the coin passage.

Here, the first and second detecting coils are disposed in such a manner that a disposing direction of the plurality of leg sections of the core coincides with a direction of passage of the coin under inspection Furthermore, the first and second detecting coils are connected serially in reverse phase, in such a manner that a mutual inductance thereof is negative.

Furthermore, the present invention provides a coin inspection device for examining physical properties of a coin and inspecting authenticity of the coin, comprising: a coin insertion slot; a coin passage coupled to the coin insertion slot; a first detecting coil disposed along the coin passage and generating a first double-peak shaped magnetic field toward the coin passage; a second detecting coil disposed opposing the first detecting coil on the other side of the coin passage therefrom and generating a second double-peak shaped magnetic field toward the coin; an oscillating circuit comprising the first and second detecting coil as a resonance element; a detection circuit for detecting changes in electrical properties of the first and second detecting coils on the basis of an output of the oscillating circuit; storing means for storing reference values for acceptable coins; comparing means for comparing a detection output of the detection circuit with the reference values stored in the storing means; and determining means for determining authenticity of the coin inserted via the coin insertion slot, on the basis of a comparison output of the comparing means.

Here, the first and second detecting coils respectively comprise: a core having a plurality of leg sections; first and second detecting coils provided respectively on two adjacent leg sections of the core; and magnetic field generating means for generating a double-peak shaped magnetic field by exciting the first and second detecting coils in such a manner that magnetic fluxes generated by magnetic poles formed by the two leg sections repel with each other.

Furthermore, the first and second detecting coils are disposed in such a manner that a disposing direction of the plurality of leg sections of the core coincides with a direction of passage of the coin under inspection.

Furthermore, the first and second detecting coils are connected serially in reverse phase, in such a manner that a mutual inductance thereof is negative.

In this invention, by adopting the composition described above, the detecting coils are self-excited by means of the oscillating circuit, and hence the magnetic fluxes between the two adjacent magnetic poles of the detecting coils repel with each other, thereby generating a double-peak shaped magnetic field. This double-peak shaped magnetic field is concentrated into respective beam shapes, which have an electromagnetic inducting action on the edge portions (flanges) of the coin and the surface section of the coin.

Due to the electromagnetic induction generated when the coin edge portions (flanges) pass between the aforementioned two magnetic poles, an eddy current is generated in the vicinity of the coin edge portions (flanges), and this eddy current generates an opposing magnetic field which disturbs the original magnetic field generated by the detecting coils, and hence causes the electrical properties (impedance) of the detecting coils to change. This impedance change varies in accordance with the features of the shape of the coin edge portions (flanges).

On the other hand, due to the electromagnetic induction arising when the pattern on the surface of the coin passes between the aforementioned two magnetic poles, an eddy current is generated in the vicinity of the coin surface region, and similarly to the foregoing, this eddy current generates an opposing magnetic field which disturbs the original magnetic field generated by the detecting coils, and hence causes the impedance of the detecting coils to change. This impedance change varies in accordance with the features of the indentations in the pattern on the coin surface.

In this way, since it is possible to cause a double-peak shaped magnetic field concentrated into beam shapes to act on the coin edge portions (flanges) and narrow regions of the coin surface, it is possible to improve the resolution of detection, and hence coin inspection can be performed with a high level of accuracy. Moreover, it is possible to obtain a plurality of detection factors for a coin by means of a single group of detecting coils.

In this way, according to the present invention, detecting coils are formed by providing a first detecting coil on one of two adjacent leg sections of a core having a plurality of leg sections and a second detecting coil on the other one of the leg section respectively; a double-peak shaped magnetic field is generated by exciting the first and second detecting coils in such a manner that magnetic fluxes generated at magnetic poles formed by the leg sections repel each other; a coin under inspection is caused to pass through the double-peak shaped magnetic field; and characteristics of the coin under inspection are inspected on the basis of changes in electrical properties of the detecting coils generated by the passage of the coin under inspection. Consequently, the shape of the coin edge portions (flanges) and the indentation patterns in the coin surface can be detected by means of a simple group of coils, and hence it is possible to provide a compact and inexpensive coin inspection device having high performance, for inspecting the authenticity of a plurality of coins.

BRIEF DESCRIPTION OF THF DRAWINGS

FIGS. 1(*a*) to 1(*c*) are diagrams showing one example of a detecting coil employed in a coin inspection method and a device relating to this invention;

FIGS. 2(*a*) and 2(*b*) are detailed illustrative diagrams of the detecting coil shown in FIG. 1;

Figure 6:
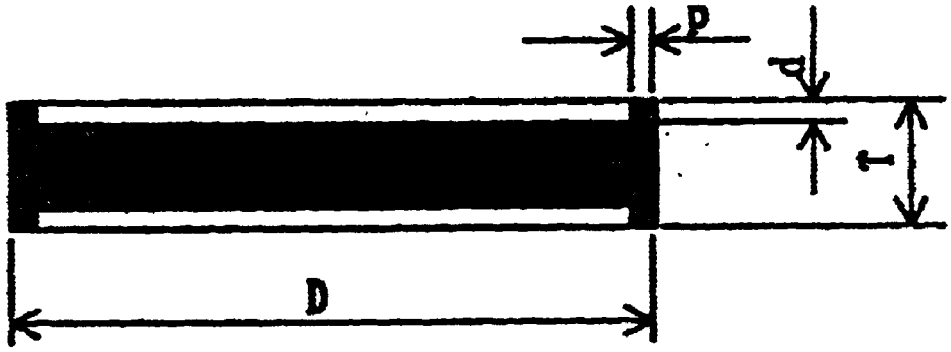
FIG. 6 is a diagram of the shape of a test gauge used to test the coin inspection device according to this embodiment.
Figure 7A:
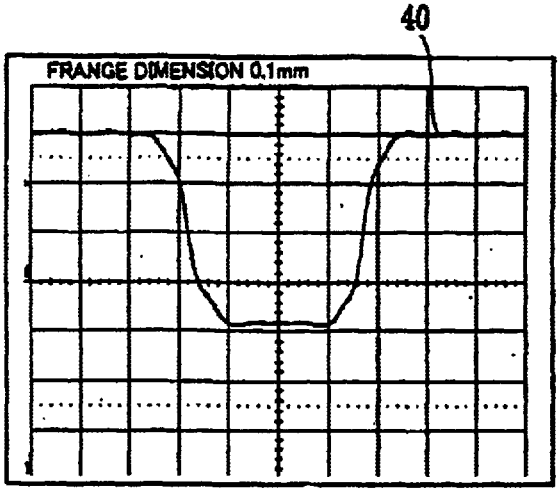
Figure 7D:
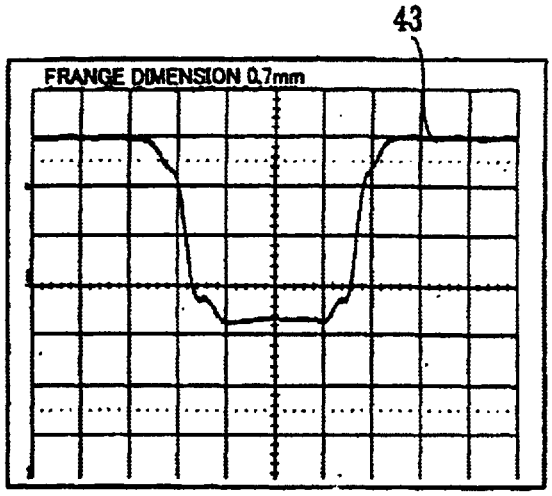
Figure 7B:
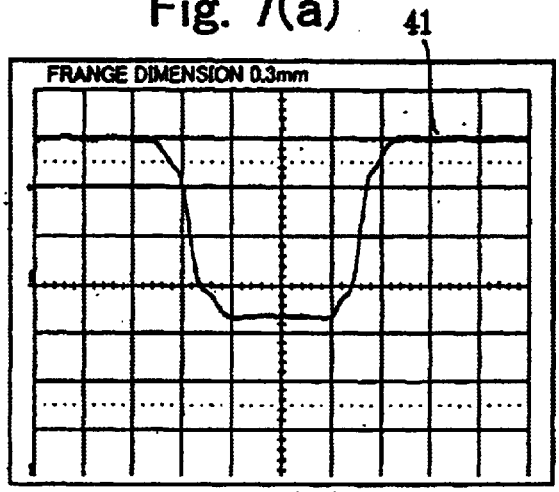
Figure 7E:
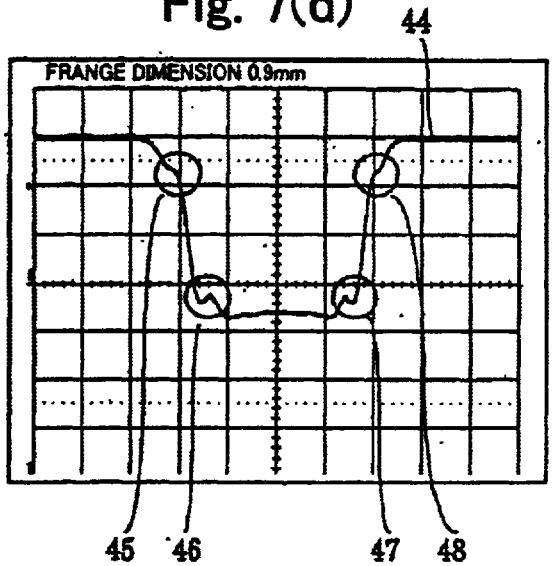
Figure 7C:
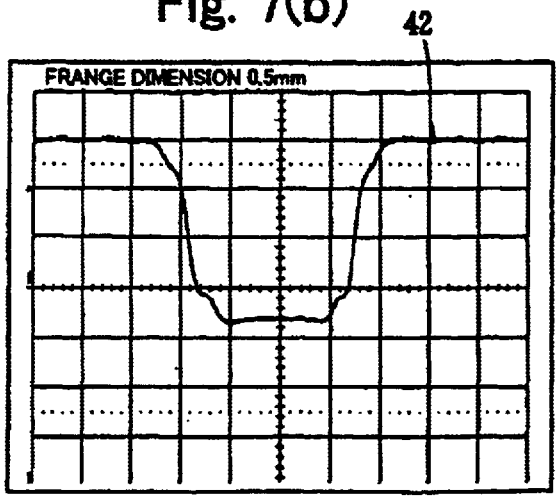
Figure 8A:
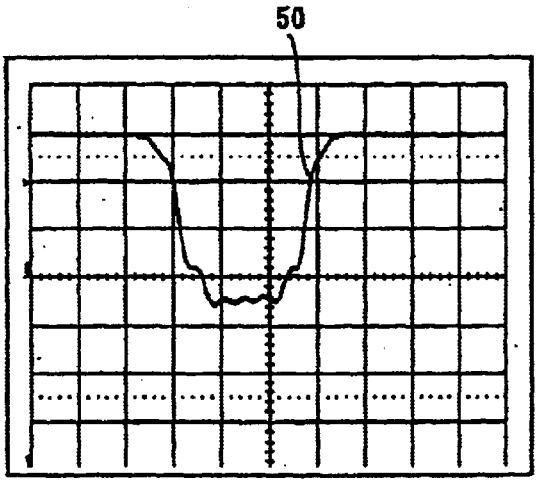
Figure 8B:
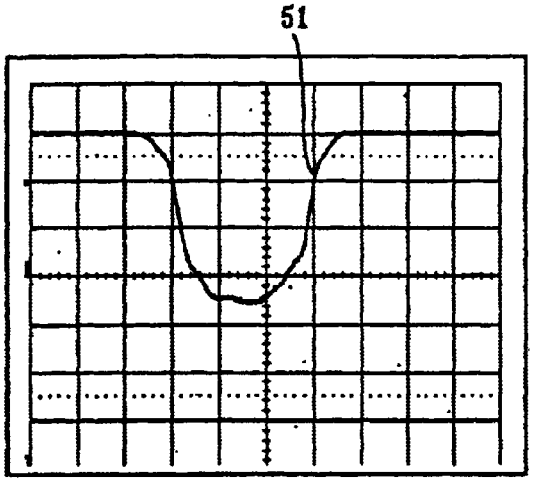
Figure 9:
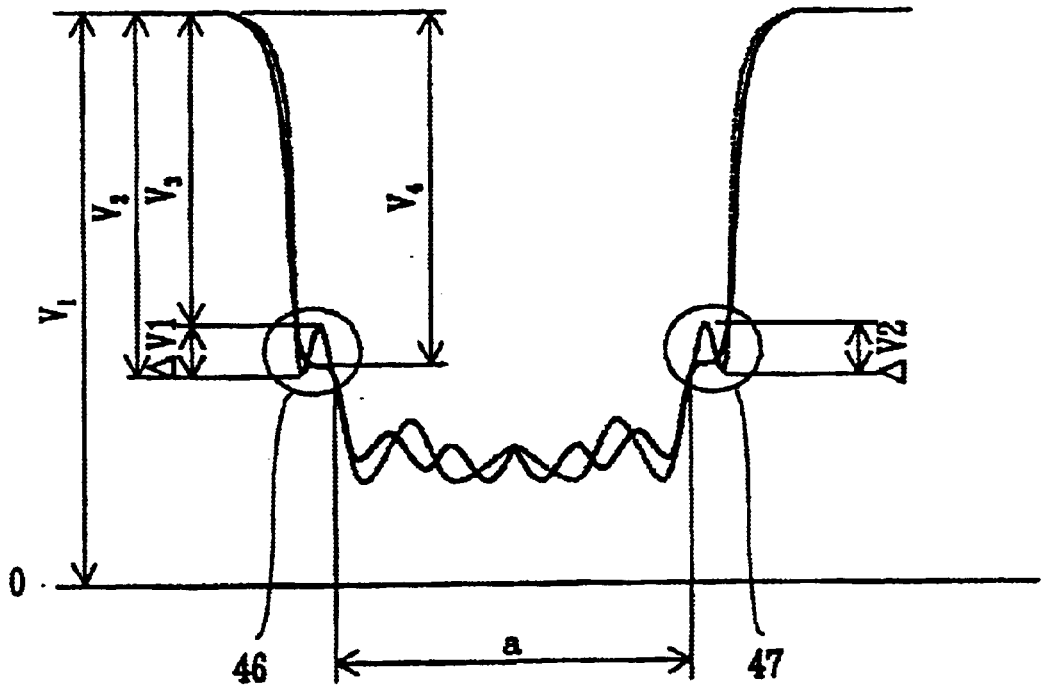
Figure 10:
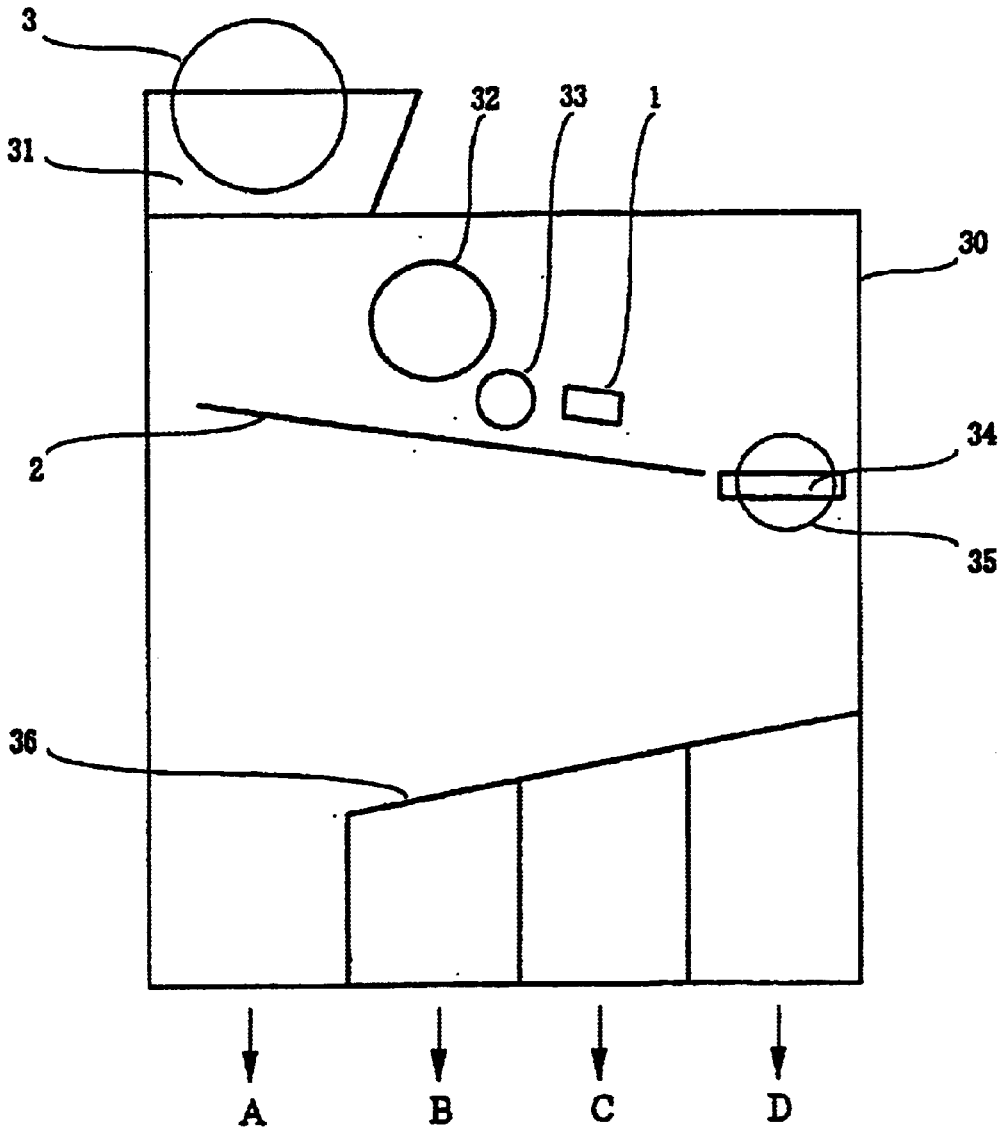
Figure 11:
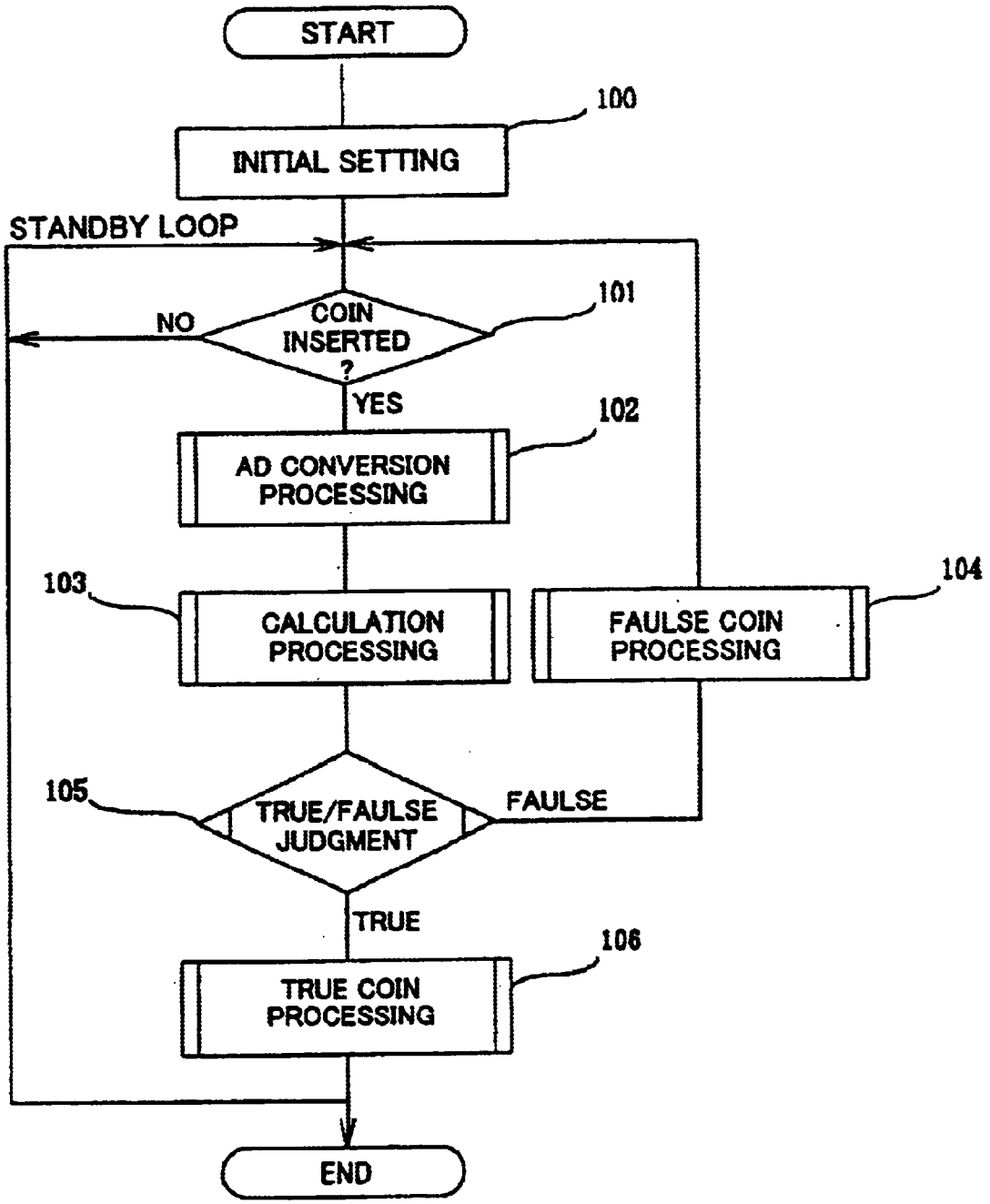
Figure 12A:
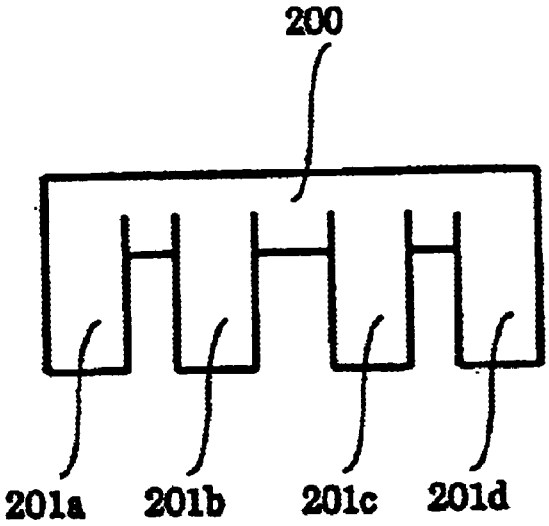
Figure 12B:
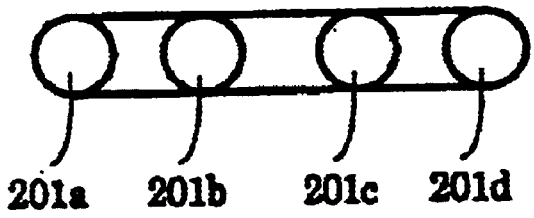
Figure 13A:
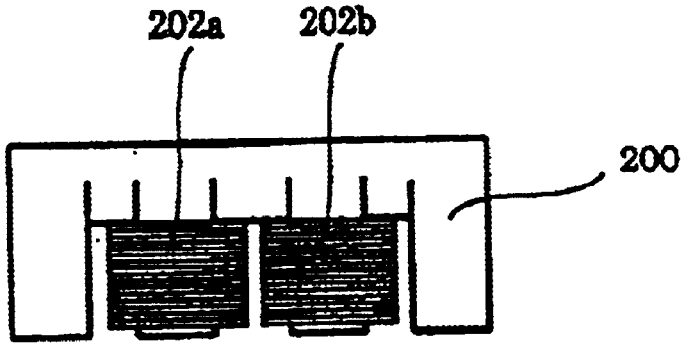
Figure 13B:
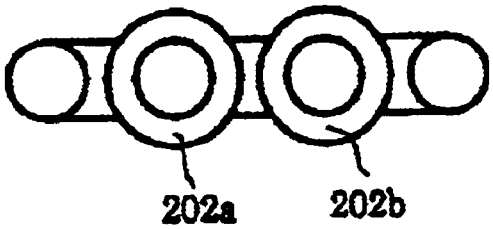
Figure 14A:
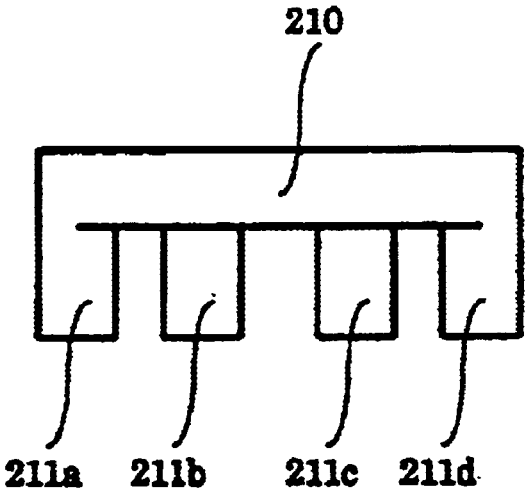
Figure 14B:
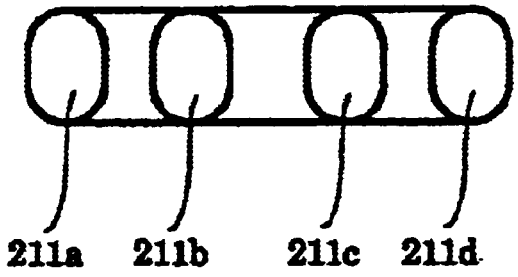
Figure 15A:
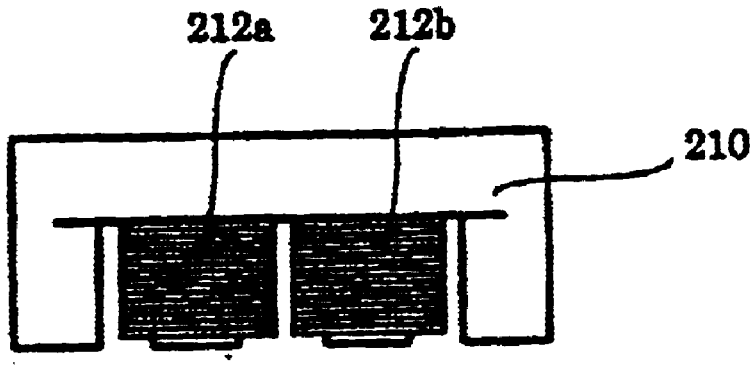
Figure 15B:
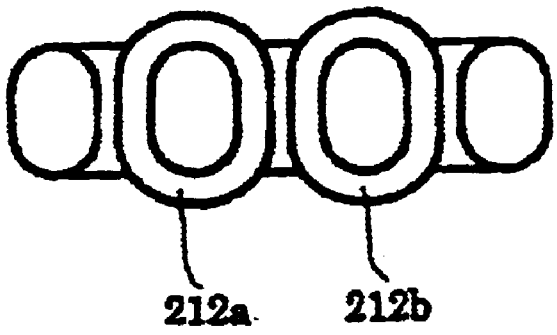
Figure 16A:
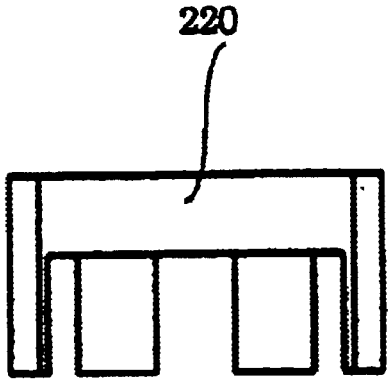
Figure 16B:
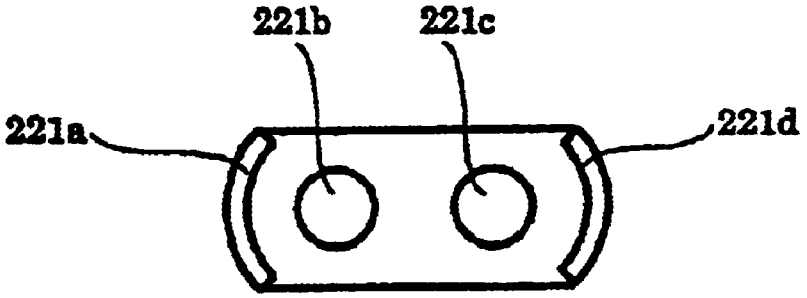
Figure 17A:
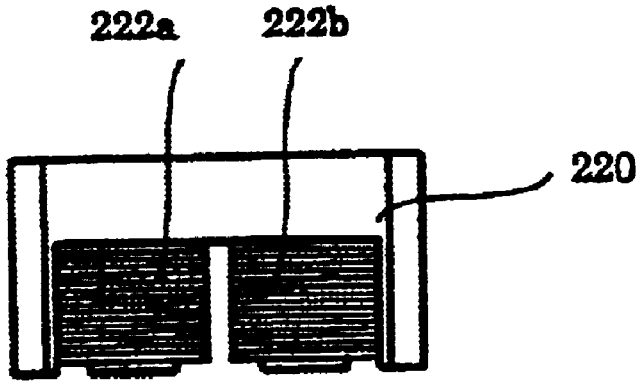
Figure 17B:
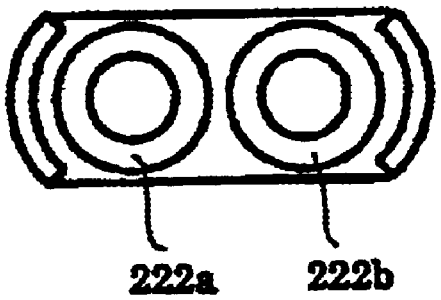
Figure 18:
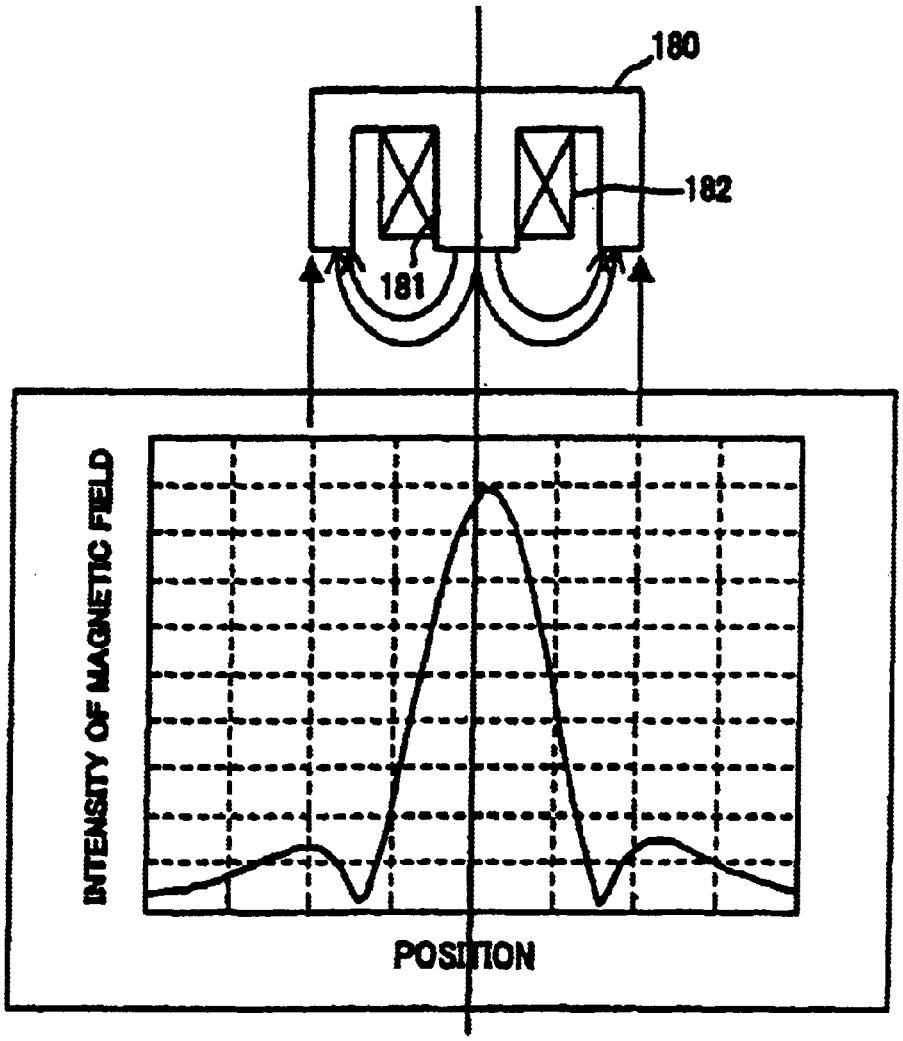

FIGS. 7(*a*) to 7(*e*) are characteristics graphs of a coin inspection device according to this embodiment, showing the results of performing a test by means of the testing gauge illustrated in FIG. 6;

FIGS. 8(*a*) and 8(*b*) are characteristics graphs of a coin inspection device according to this embodiment, showing the results of performing a test by means of a representative coin;

FIG. 9 is a diagram showing the details of a coin inspection procedure implemented by the coin inspection device according to this embodiment;

FIG. 10 is a diagram showing a coin processing device for an automatic vending machine, or the like, constituted by using the coin inspection device relating to the present invention;

FIG. 11 is a flowchart describing the operation of the coin inspection device relating to the present invention;

FIGS. 12(*a*) and 12(*b*) are diagrams showing a further example of a core of a detecting coil employed in a coin inspection method and device relating to the present invention;

FIGS. 13(*a*) and 13(*b*) are diagrams showing a detecting coil constituted by using the core illustrated in FIGS. 12(*a*) and 12(*b*);

FIGS. 14(*a*) and 14(*b*) are diagrams showing yet a further example of a core of a detecting coil employed in a coin inspection method and device relating to the present invention;

FIGS. 15(*a*) and 15(*b*) are diagrams showing a detecting coil constituted by using the core illustrated in FIGS. 14(*a*) and 14(*b*);

FIGS. 16(*a*) and 16(*b*) are diagrams showing yet a further example of a core of a detecting coil employed in a coin inspection method and device relating to the present invention;

FIGS. 17(*a*) and 17(*b*) are diagrams showing a detecting coil constituted by using the core illustrated in FIGS. 16(*a*) and 16(*b*); and FIG. 18 is a characteristics graph for an induction coil used in a conventional coin inspection device.

DESCRIPTION OF THE PREFERRED EMBODIMENTS

Below, an embodiment of the coin inspection method and device relating to this invention is described in detail with reference to the accompanying drawings.

Figure 1A:
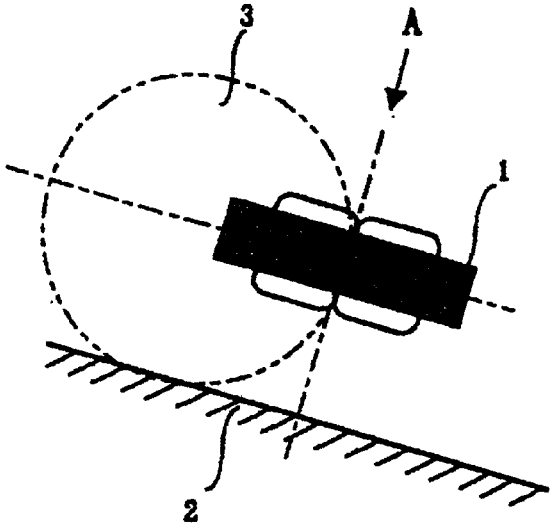
Figure 1B:
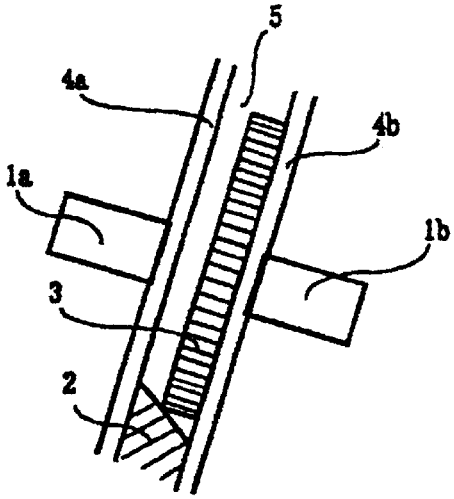
Figure 1C:
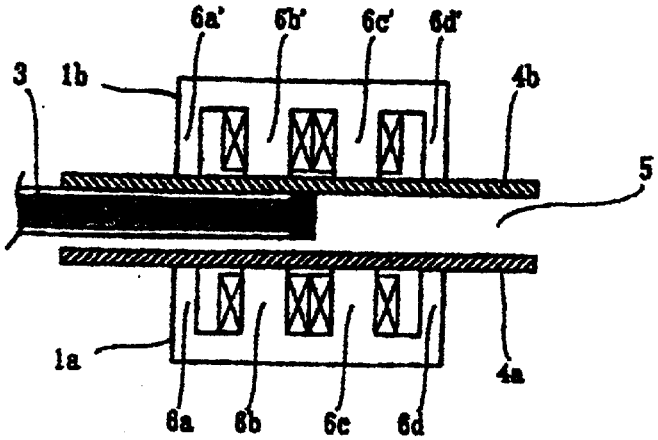

FIGS. 1(*a*) to 1(*c*) are diagrams showing a detecting coil employed in the coin inspection method and device relating to this invention.

Figure 2A:
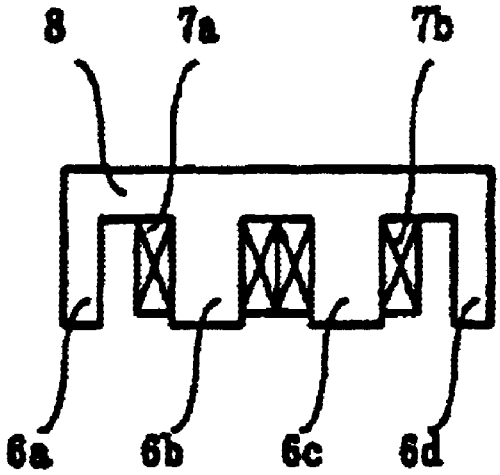
Figure 2B:
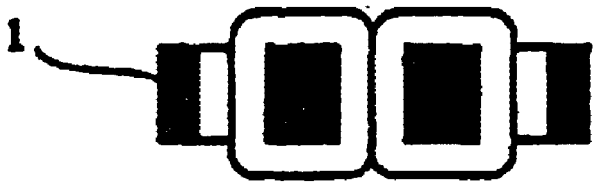

FIGS. 2(*a*) and 2(*b*) are detailed illustrations of the detecting coil shown in FIGS. 1(*a*) to 1(*c*).

In FIGS. 1(*a*) to 1(*c*), FIG. 1(*a*) shows a front view of a detecting coil 1 used in a coin inspection method and device relating to the present invention; FIG. 1(*b*) is a sectional view of a coin passage 5 in which the detecting coil 1 shown in FIG. 1(*a*) is disposed; and FIG. 1(*c*) is a view in the direction of arrow A of the detecting coil 1 shown in FIG. 1(*a*).

In FIGS. 1(*a*) to 1(*c*), the detecting coil 1 is constituted by a first detecting coil 1*a* and a second detecting coil 1*b*, the first detecting coil 1*a* being disposed on the passage wall 4*a* of one side portion of a coin passage 5 and the second detecting coil 1*b* being disposed on the other side of the coin passage 5, in such a manner that it is coupled electromagnetically with the first detecting coil 1*a*.

Moreover, the detecting coils 1 are disposed in such a fashion that the longitudinal direction thereof is approximately parallel to a rail 2 which constitutes the under face of the coin passage 5, and in such a fashion that the centre of the coin 3 approximately coincides with the centre of the detecting coils 1 in the lateral direction thereof The coin passage 5 is constituted by a rail 2 disposed in the lower portion thereof and inclined at a prescribed angle whereby the coins 3 are guided and allowed to drop, and a pair of passage walls 4*a,* 4*b,* these passage walls 4*a,* 4*b* being disposed perpendicularly in the direction of fall of the coins and at an inclined angle with respect to the vertical direction, in such a manner that a coin 3 is inclined to the side of one passage wall 4*b* as it falls downwards, as illustrated in FIG. 1(*b*).

Furthermore, the surface of the rail 2 which bears and guides the coin 3 has a composition whereby it is inclined in the direction of inclination of the passage walls 4*a,* 4*b,* in such a manner that the passing coin 3 is inclined to the side of the passage wall 4*b.*

As illustrated in FIG. 2(*a*) and FIG. 2(*b*), the detecting coil 1 is made from a magnetic material of high induction rate, such as ferrite, or the like, and is constituted by a comb-shaped core 8 comprising a plurality of legs disposed in virtually linear fashion at prescribed intervals, a coil 7*a* and coil 7*b* being wound respectively about two adjacent inner leg sections 6*b* and 6*c* of the comb-shaped core 8.

Moreover, as described hereinafter, the first detecting coil 1*a* of these detecting coils 1 is connected in such a fashion that the magnetic fluxes generated from the magnetic poles formed by the two adjacent inner leg sections 6*b* and 6*c* within the first detecting coil 1*a* repel with each other.

Similarly, the second detecting coil 1*b* is connected in such a manner that the magnetic fluxes generated from the magnetic poles formed by the two inner leg sections 6*b*' and 6*c*' repel with each other. Moreover, the first detecting coil 1*a* and the second detecting coil 1*b* are connected serially in reverse phase, in such a manner that the mutual inductance thereof is negative.

Figure 3:
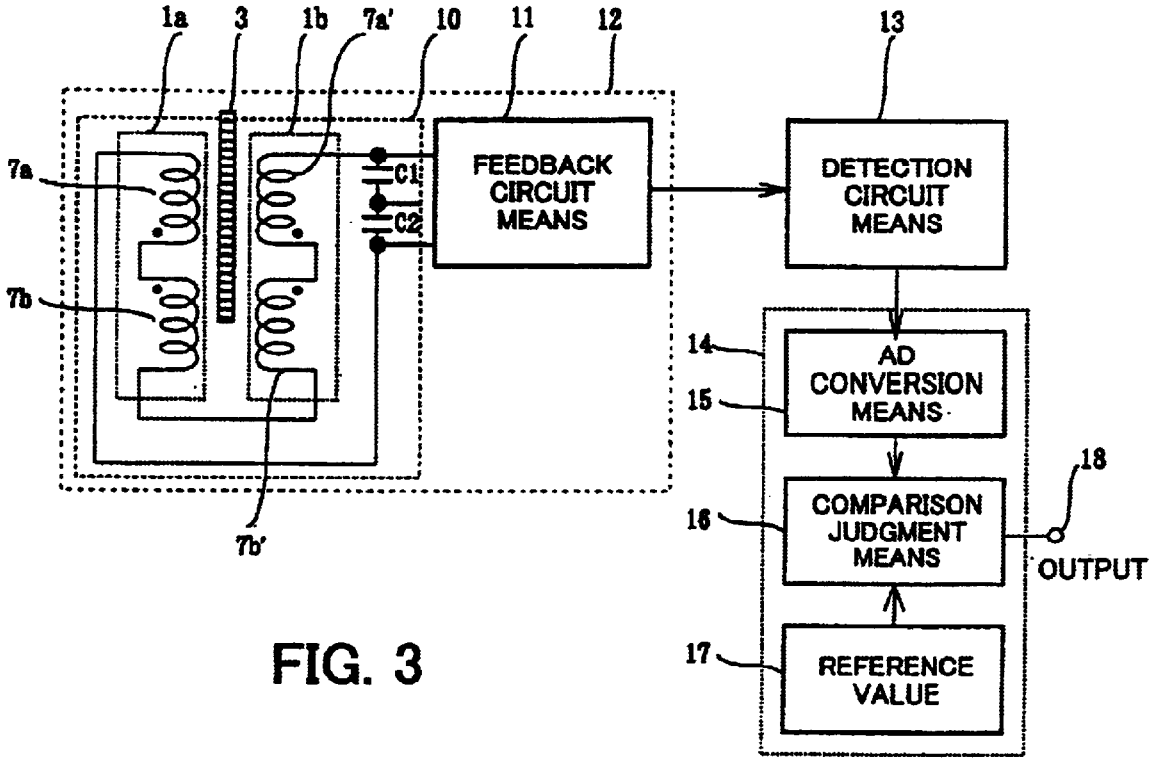
FIG. 3 is a block diagram showing the approximate composition of a control circuit of a coin inspection device wherein the coin inspection method and device relating to this invention are employed, constituted using the detecting coil 1 illustrated in FIG. 1.

FIG. 3 is a block diagram showing the approximate composition of a control circuit of a coin inspection device wherein a coin inspection method and device relating to the present invention and constituted by means of detecting coils 1 as illustrated in FIG. 1 are adopted.

In FIG. 3, the first detecting coil 1*a* constituting the detecting coils 1 illustrated in FIG. 1 consists of coils 7*a,* 7*b,* these coils 7*a,* 7*b* being connected in such a manner that the magnetic fluxes generated at the magnetic poles formed by the two adjacent inner leg sections 6*b,* 6*c* shown in FIG. 1 repel with each other, and similarly, a second detecting coil 1*b* consists of coils 7*a*', 7*b*', these coils 7*a*', 7*b*' being connected in such a manner that the magnetic fluxes generated at the magnetic poles formed by the two adjacent inner leg sections 6*b*', 6*c*' repel with each other.

A capacitor C1 and a capacitor C2 are connected in parallel to the first detecting coil 1*a* and the second detecting coil 1*b,* and a resonance element 10 is formed by the first detecting coil 1*a,* second detecting coil 1*b,* capacitor C1 and capacitor C2.

Furthermore, together with a feedback circuit 11, the resonance element 10 forms a self-exciting resonance circuit 12, this resonance circuit 12 being excited at a frequency based on the resonance frequency of the resonance element 10 and a sinusoidal voltage being generated at either end of the detecting coils 1, thereby exciting and driving the detecting coils 1.

Thereby, the detecting coils 1 generate an electromagnetic field in the vicinity thereof, the first detecting coil 1*a* and the second detecting coil 1*b* creating electromagnetic fields in such a manner that they are electromagnetically coupled.

Furthermore, an oscillating circuit 12 outputs the sinusoidal voltage generated at either end of the detecting coils 1 to a detection circuit 13. The detection circuit 13 inputs and detects the sinusoidal voltage output by the oscillating circuit 12, and generates a DC voltage corresponding to this sinusoidal voltage, which it outputs to the inspection device 14.

The inspection device 14 inputs the aforementioned DC voltage signal to an internal AD converting section 15, where it is converted to a corresponding digital voltage signal and output to a comparison judgement means 16 contained inside the inspection device 14. The comparison judgement means 16 compares the digital voltage signal with a reference voltage 17, judges whether or not a coin 3 possesses prescribed features, and outputs this judgement result to an output terminal 18.

The output of the comparison judgement means 16 is used to drive a directing solenoid, described hereinafter, and a coin counter, or the like (not illustrated).

Here, the electromagnetic action arising when a coin 3 passes through the electromagnetic field of the detecting coil 1 is described in detail.

Figure 4:
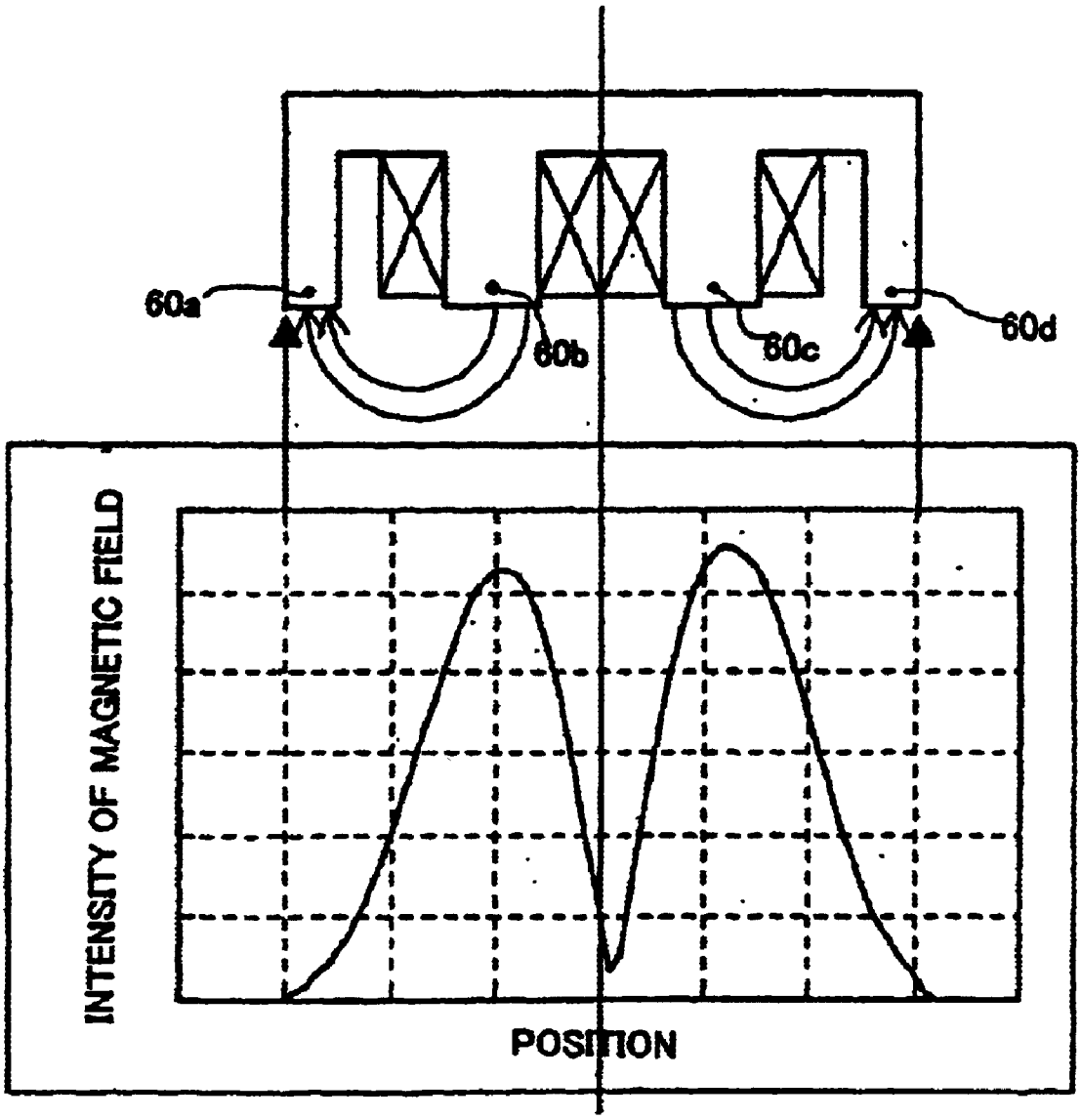
FIG. 4 is a characteristics graph showing the characteristics of the detecting coil 1 illustrated in FIG. 1.

FIG. 4 is a graph showing the characteristics of the detecting coil 1 illustrated in FIG. 1.

The characteristics graph shown in FIG. 4 illustrates measurements of the strength of the magnetic field obtained by placing a magnetic flux meter at a position approximately 1 mm from the surface of the magnetic pole of the core, and moving the magnetic flux meter in the direction in which the magnetic poles are aligned. Furthermore, in the characteristics graph shown in FIG. 4, the measurements are made by exciting and driving the first detecting coil 1*a* described above, by a prescribed voltage and a prescribed frequency.

In FIG. 4, looking at the strength of the magnetic field at magnetic poles 60*a* to 60*d* in the leg sections of the comb-shaped core 8 of the detecting coils 1, it is seen that a double-peak shaped graph is obtained, having respective field strength peaks at the vicinity of the magnetic pole 60*b* and the magnetic pole 60*c,* respectively.

The reason that the detecting coils 1 display these characteristics is that the magnetic fluxes generated at the two adjacent magnetic poles repel with each other, and hence a trough where the magnetic field declines sharply is generated in the central region between the magnetic pole 60*b* and the magnetic pole 60*c*. Thereby, the double-peaked magnetic field is such that it causes a magnetic field which is concentrated into a beam shape to act on the surface of the coin.

Next, to describe the electromagnetic action between the coin and the coils, when a coin 3 acts upon the electromagnetic field of the detecting coils 1, an eddy current is generated in the vicinity of the surface of the coin 3, according to commonly known principles.

This eddy current generated in the vicinity of the surface of the coin 3 acts in such a manner that due to the magnetic field generated by the eddy current, it disturbs the original magnetic field generated by the detecting coils 1.

Due to this action, the impedance of the detecting coils 1 changes, and the sinusoidal voltage at either end of the detecting coils 1 is attenuated.

Since the change in the sinusoidal voltage generated in this way corresponds to the features of the coin, it is possible to investigate the features of the coin 3 by detecting and inspecting the change in the sinusoidal voltage.

Moreover, due to the surface action generated as the acting frequency thereof increases, the eddy current generated in the vicinity of the surface of the coin 3 produces a marked opposing magnetic field in the vicinity of the coin outer periphery.

Furthermore, due to the action on the surface of the coin 3 of the double-peaked beam-shaped magnetic field generated by the detecting coils 1, the magnetic field generates a double-peak shaped opposing magnetic field in a detailed region of the coin 3, and produces an interaction with the detecting coils 1 according to fine changes in the shape features of the coin surface, and therefore, it is possible to inspect the shape of the coin edge sections (flanges) and the indentations in the coin surface pattern, by detecting the aforementioned changes.

Figure 5:
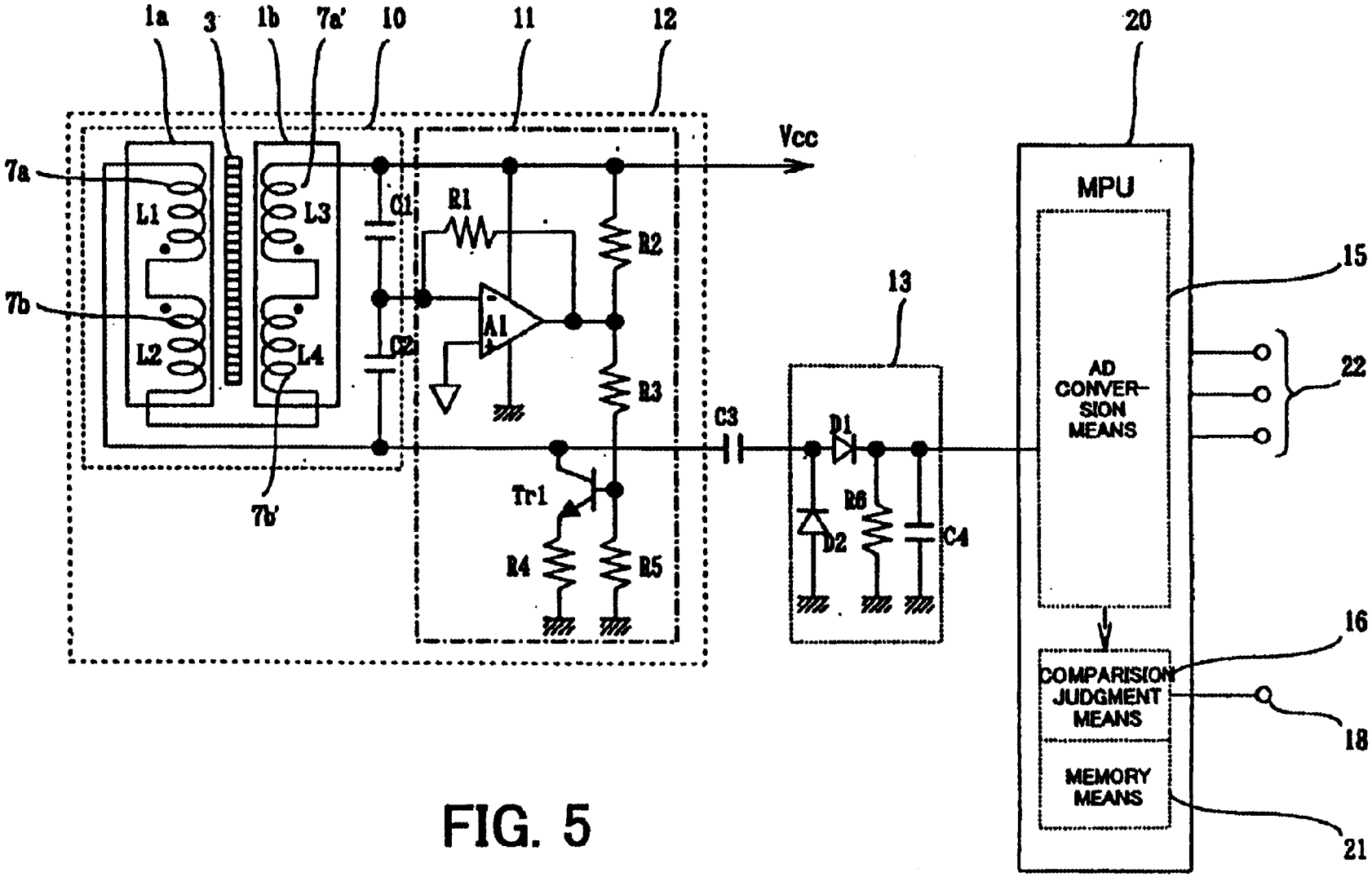
FIG. 5 is a circuit diagram showing the detailed composition of the coin inspection device illustrated in FIG. 3.

FIG. 5 is a circuit diagram showing the detailed composition of the coin inspection device illustrated in FIG. 3.

In FIG. 5, describing a circuit composition which corresponds to the block diagram in FIG. 3, the oscillating circuit 12 including the feedback circuit 11 shown in FIG. 3 is constituted by the resonance element 10 consisting of the detecting coil 1 comprising the first detecting coil 1*a* and second detecting coil 1*b* and the capacitor C1 and capacitor C2, a feedback amplifier circuit consisting of an amplifier A1, resistance R1 and resistance R2, and a transistor Tr1, bias resistances R3, R5 and emitter resistance R4.

Moreover, the detection circuit 13 shown in FIG. 3 is constituted by a rectifying circuit comprising a diode D1 and diode D2 connected to a coupling capacitor C3 which is connected to the output of the oscillating circuit 12, and an integrating circuit consisting of a resistance R6 and capacitor C4.

Furthermore, the AD conversion section 15, comparing and judging means 16 and reference value 17 of the inspection device 14 shown in FIG. 3 are constituted by an MPU (microprocessor unit) 20.

The oscillating circuit 12 excites and drives the detecting coils 1 at a prescribed frequency, and desirably, this frequency is such that the electromagnetic field does not penetrate the coin, for example, a frequency of 70 k(Hz) or above. In the present embodiment, the frequency was set to 120 k(Hz).

When a coin 3 is positioned in the vicinity of the detecting coils 1 constituted by the first detecting coil 1*a* and the second detecting coil 1*b* of the oscillating circuit 12, an eddy current is generated inside the coin 3, and due to the action of the opposing magnetic field generated by this eddy current, the magnetic flux produced by the detecting coils 1 is disturbed, the impedance of the detecting coils 1 changes, and consequently, the amplitude, frequency, and the like, of the sinusoidal voltage changes.

In the present embodiment, a composition is adopted whereby change in amplitude is detected. The oscillating circuit 12 outputs the sinusoidal voltage generated by the detecting coils 1 to the detection circuit 13. The detection circuit 13 inputs the sinusoidal voltage from the oscillating circuit 12 and outputs a DC voltage corresponding to this sinusoidal voltage to the inspection device 14.

Furthermore, the output from the detection circuit 13 is input to the AD conversion section 15 inside the MPU 20. The AD conversion section 15 samples the input DC voltage and stores same temporarily in a memory 21. The comparison judgement means 16 compares the value temporarily stored in the memory 21 with reference values for acceptable coin denominations previously stored in the memory 21, and outputs the corresponding result to an output terminal 18.

FIG. 6 is an illustration of the shape of a testing gauge used to test the coin inspection device according to the present embodiment.

In FIG. 6, the test gauge serves to evaluate the performance of the detecting coils 1 of the coin inspection device according to this embodiment, and it is used to verify the detection performance for the coin edge sections (flanges).

The test gauge has an outer diameter measurement D of 26.5 mm, respective front surface and rear surface indentation dimensions d of 0.3 mm, and a thickness T of 1.8 m, the dimension p of the flange section being set to 5 set dimensions in 0.2 mm steps from 0.1 mm to 0.9 mm.

FIGS. 7(*a*) to 7(*e*) are characteristics graphs of a coin inspection device according to this embodiment, as a result of performing a test using the testing gauge illustrated in FIG. 6.

The characteristics graphs shown in FIGS. 7(*a*) to 7(*e*) illustrate results obtained when the test gauge is passed through the electromagnetic field of the detecting coils 1 and the corresponding output (inspection signal) of the detection circuit means 13 is measured by oscilloscope, using the control circuit illustrated in FIG. 5.

The waveform 40 in FIG. 7(*a*) is the waveform produced when the dimension p of the flange section is 0.1 mm, the waveform 41 in FIG. 7(*b*) is the waveform produced when the dimension p of the flange section is 0.3 mm, the waveform 42 in FIG. 7(*c*) is the waveform produced when the dimension p of the flange section is 0.5 mm, the waveform 43 in FIG. 7(*d*) is the waveform produced when the dimension p of the flange section is 0.7 mm, and the waveform 44 in FIG. 7(*e*) is the waveform produced when the dimension p of the flange section is 0.9 mm.

Looking at waveform 44 in FIG. 7(*e*), in particular, of the aforementioned waveforms 40–44, the change in waveform is such that the waveform starts to attenuate by the passage of the test gauge through the electromagnetic field of the detecting coil 1, then it reaches a maximum value (maximum attenuation) and then rising again and returning to the standby value.

As can be seen from the waveform 44, in the descending waveform from the point at which the waveform starts to fall until the maximum value is reached, there appear two turning points, namely, a first turning point 45 and a second turning point 46.

Furthermore, in the ascending waveform from the point at which the waveform 44 start to rise again after reaching the maximum value, until it returns to the standby value, there appear two turning points, namely a third turning point 47 and a fourth turning point 48.

Here, the first turning point 45 appears when the leading flange section of the test gauge passes between the magnetic pole 60*a* and magnetic pole 60*b* of the detecting coils 1, whilst the second turning point 46 appears when this flange section passes between the magnetic pole 60*b* and the magnetic pole 60*c*.

The third turning point 47, on the other hand, appears when the trailing flange section of the test gauge passes between the magnetic pole 6*b* and the magnetic pole 60*c* of the detecting coils 1 (see FIG. 4), whilst the fourth turning point 48 appears when this flange section passes between magnetic pole 60*c* and magnetic pole 60*d* (see FIG. 4).

Looking at the characteristics changes at the respective turning points in waveform 40 to waveform 44 illustrated in FIG. 7(*a*) to FIG. 7(*e*), which correspond to the dimensional changes of the flange section in the test gauge, it can be seen that whereas the change at the respective turning points is comparatively gentle in waveform 40 in FIG. 7(*a*) relating to a test gauge having a flange section dimension of 0.1 mm, the angle of the change becomes increasingly sharp as the dimension of the flange section increases, and the change at the second turning point 46 and third turning point 47 becomes particularly marked.

Therefore, by detecting the amount of change at the second turning point 46 and the third turning point 47 (for example, the size and direction of the inclination between the first bend and the second bend at the second turning point 46) and using this for coin identification, it is possible to inspect the features of the edge sections (flanges) of a coin with great accuracy.

FIGS. 8(*a*) and 8(*b*) are characteristics graphs for a coin inspection device according to the present embodiment, showing the results of performing a test using a typical coin.

In FIGS. 8(*a*) and 8(*b*), waveform 50 in FIG. 8(*a*) is a characteristics graph for a Japanese 100 yen coin; and waveform 51 in FIG. 8(*b*) is a characteristics graph for a suspect coin having material properties, outer form, thickness, weight, and the like, which are extremely similar to those of a 100 yen coin.

Comparing the waveform 50 of FIG. 8(*a*) with the waveform 51 of FIG. 8(*b*), whereas the bend in the second turning point in waveform 50 is very sharp, that in waveform 51 shows a more gentle change, and hence there is a clear difference between the two waveforms.

Moreover, in waveform 50, undulations appears in the vicinity of the maximum value (maximum attenuation), whereas in waveform 51, the corresponding characteristics are flat, and hence there is a further clear difference between the two waveforms. Here, the undulating waveform which appears in the vicinity of the maximum value in waveform 50 indicates detection of undulations in the pattern printed onto the surface of the 100 yen coin.

As illustrated by the characteristics graphs shown in FIGS. 8(*a*) and 8(*b*), by detecting differences in the shape of the coin edge sections (flanges) and the pattern on the surface of the coin, it is possible to identify a suspect coin having very similar material properties, outer shape, thickness, weight, and the like, to a genuine coin.

FIG. 9 is a diagram for describing the details of a coin inspection method based on the coin inspection device according to the present embodiment.

In FIG. 9, the solid lines indicate a coin waveform for a Japanese 500 yen coin (hereinafter, called 'genuine coin'), and the dotted lines indicates a coin waveform for a Hungarian 50 Forint coin (hereinafter, called 'false coin'), which has very similar material properties, outer shape, and thickness to a 500 yen coin.

In order to detect the features of the coin edge sections from these coin waveforms, since the features of the coin edge sections appear notably at the second turning point 46 and third turning point 47, the amount of change in the signal at these respective turning points is extracted.

Specifically, if the inserted coin is a genuine coin, then at the change in waveform at the second turning point 46, the change from the bending point which is encountered first as the waveform descends (hereinafter, called the "first bending point") until the subsequent bending point (hereinafter, called the "second bending point") shows approximately flat characteristics, and hence the voltage difference $\Delta V1$ between the amount of voltage change at the first bending point and the amount of voltage change at the second bending point is slight.

At the third turning point 47, the voltage difference $\Delta V2$ between the amount of voltage change at the third bending point and the amount of voltage change at the fourth bending point is derived in a similar manner.

Moreover, since a judgement reference value for identifying coins is required, as a method for obtaining this reference value, measurements are made for N number of normal coins of a prescribed denomination, using the coin inspection device according to this embodiment, and by statistically processing respective data for the aforementioned voltage differences $\Delta V1$ and $\Delta V2$, a reference value which accounts for variation between similar coins is obtained.

On the other hand, in the case of a false coin, the voltage difference $\Delta V1$ between the amount of voltage change V2 at the first bending point and the amount of voltage change V3 at the second bending point is greater than in the case of a genuine coin.

Thereby, it is possible to perform authenticity judgement by comparing the reference value for the voltage difference in the case of a genuine coin with the voltage difference obtained for a false coin.

Moreover, if it is sought to identify the differences between absolute voltage levels in the foregoing calculations, then there will be variations in the environmental conditions, such as temperature, or the like, in which the device is used, and hence a commonly known method for normalizing the aforementioned amount of voltage change by means of the standby voltage V1 is adopted. For example, by using a normalizing process, whereby the amount of voltage change V4 at the second turning point 46 for a genuine coin is divided by the standby voltage V1 to give a ratio, it is possible to avoid problems occurring due to temperature change, or the like.

Next, a concrete method for detecting the pattern on a coin surface is described.

As described above, the waveform in the maximum change region a in FIG. 9 indicates the features of the indentation pattern on a coin surface. Moreover, since this waveform is different for a genuine coin and for a false coin, it is possible to perform authenticity judgement by detecting the differences therebetween.

For example, a correlation coefficient is determined for the sampling data in the maximum change region a by means of a commonly known calculation formula, and it is determined whether or not this value is within the range of the reference value. Alternatively, a similar judgement process can be implemented by using the average value of the sampling data in the maximum change region a. Frequency changes may also be used.

FIG. 10 is a diagram showing a coin processing device for an automatic vending device, or the like, constituted by means of the coin inspection device relating to the present invention.

In the coin processing device 30 in FIG. 10, a coin 3 inserted via a coin insertion slot 31 drops by means of gravity onto a rail 2 provided beneath the coin insertion slot 31.

The coin 3 which has dropped onto the rail 2 rolls downwards in a direction away from the coin insertion slot 31, along the coin passage 5 (see FIG. 1). Whilst moving along the coin passage 5, the coin 3 passes by an outer diameter detecting coil 32, a material properties detecting coil 33 and detecting coils 1 relating to the present invention.

The coin processing device 30 inspects the authenticity and denomination of the coin 3, whilst the coin 3 passes the aforementioned respective detecting coils. As a result of this inspection process, if it is judged that the inserted coin 3 is a genuine coin, then the director solenoid 35 is driven on the basis of a signal output from the output terminal 18, thereby operating the gate 34 and directing the coin 3 into a genuine coin passage (not illustrated).

However, if it is judged as a result of the inspection process that the coin 3 is a false coin, then the gate 34 is not operated, and the coin 3 is directed to a false coin passage (not illustrated) and discharged from a discharge outlet (not illustrated).

Here, assuming that the coin 3 is a genuine coin, the coin directed along the genuine coin passage continues to fall under gravity until it reaches a rail 36. The coin 3 which has dropped down onto the rail 36 is sorted with respect to its denomination by commonly known sorting means (not illustrated) and discharged by means of a respective discharge outlet A, B, C, D corresponding to the coin denomination.

Here, it is possible to use commonly known techniques for the inspection methods using an outer diameter detecting coil 32 and material properties detecting coil 33.

FIG. 11 is a flowchart describing the action of a coin inspection device relating to this invention.

In FIG. 11, when the power supply to the coin inspection device is switched on, initial settings for inputs, outputs, and the like, within the MPU 20 are made at step 100.

After implementing step 100, in the judgement processing at step 101, processing is implemented to judge whether or not a coin has been inserted into the device, by means of a signal from the detecting coils 32 and 33. If it is judged from the processing at step 101 that a coin has been inserted, then the program proceeds to AD conversion processing at step 102. However, if it is judged in the processing at step 101 that no coin has been inserted, then a standby processing loop is entered, in such a manner that the program awaits the arrival of a coin. Here, it is assumed that a coin has been inserted in the judgement processing implemented at step 101, and hence the program has advanced to the AD conversion processing at step 102.

In the AD conversion processing in step 102, when a coin arrives within the detecting coil, the corresponding signal is received and sampling is started for each detecting coil. The sampling results are stored and held temporarily in a memory 21, such as a RAM, or the like, within the MPU 20, whereupon the program advances to calculation processing at step 103.

The calculation processing at step 103 is performed using the value stored temporarily in the memory 21, and the values for acceptable coins previously stored in the memory 21, whereupon the program advances to the authenticity judgement processing at step 105.

In the authenticity judgement processing at step 105, the value determined by the calculation processing at step 103 is compared with the previously stored reference values for acceptable coins, and if this value is within the reference values, then it is judged that the coin under inspection is genuine, and hence the program advances to the genuine coin processing at step 106. However, if it is determined that the value is outside the reference values, and hence it is judged that the coin under inspection is false, then the false coin processing at step 104 is implemented and the program reverts to a standby loop.

Here, it is assumed that the coin under inspection has been judged to be a genuine coin in the authenticity judgement processing at step 105, and hence the genuine coin processing at step 106 is carried out. The genuine coin processing at step 106 involves implementation of processing for outputting a genuine coin signal, coin denomination signal, and the like, on the basis of the aforementioned judgement results, whereupon the program reverts to the standby loop.

Here, the program completes a sequence of processing steps and then returns to step 101 and enters a standby processing loop.

As described above, according to the present embodiment, detecting coils 1 generating a double-peak shaped magnetic field are formed by winding a first coil 7*a* and a second coil 7*b* respectively about two adjacent inner leg sections 6*b*, 6*c* of a comb-shaped core 8, the first coil 7*a* and the second coil 7*b* being excited in such a manner that the magnetic fluxes generated by the two magnetic poles 60*b*, 60*c* repel with each other, and a coin 3 under inspection is caused to pass through the double-peak shaped magnetic field generated by the detecting coils 1, the authenticity and the denomination of the coin 3 under inspection being identified on the basis of the change in impedance caused in the detecting coils 1 by the passage of the coin 3 under inspection.

By adopting the composition described above, it is possible to improve substantially the sensitivity of detecting the shape of the edge sections of a coin and the indentations on the surface of a coin.

In the embodiment described above, the shape between the leg sections in the comb-shaped core of the detecting coils 1 was a square U shape, but it is also possible to adopt another shape, as appropriate, such as a normal U shape, or the like, within a range which does not deviate from the essence of the present invention.

For example, as illustrated in FIG. 12(*a*) and FIG. 12(*b*), it is also possible to constitute detecting coils by using a comb-shaped core 200 comprising leg sections 201*a*–201*d* having a cylindrical cross-sectional shape, and winding coils 202*a*, 202*b* respectively about two adjacent inner leg sections 201*b*, 201*c* of the comb-shaped core 200, as illustrated in FIG. 13(*a*) and FIG. 13(*b*).

Furthermore, as illustrated in FIG. 14(*a*) and FIG. 14(*b*), it is also possible to constitute detecting coils by using a comb-shaped core 210 comprising outer leg sections 211*a*, 211*d* and inner leg sections 211*b*, 211*c* having an oval cross-sectional shape, and winding coils 212*a*, 212*b* respectively about two adjacent inner leg sections 211*b*, 211*c* of the comb-shaped core 210, as illustrated in FIG. 15(*a*) and FIG. 15(*b*).

Furthermore, as illustrated in FIG. 16(*a*) and FIG. 16(*b*), it is also possible to constitute detecting coils by using a core 220 comprising inner leg sections 221*b* and 221*c* having a circular cross-sectional shape and ring sections 221*a* and 221*d* having a ring shape, and winding coils 222*a*, 222*b* respectively about the two adjacent inner leg sections 221*b*, 221*c* of the comb-shaped core 220, as illustrated in FIG. 17(*a*) and FIG. 17(*b*). Moreover, although a composition was adopted whereby detecting coils 1 are disposed in opposing positions on either side of the passage 5, it is also possible to adopt a composition whereby only one detecting coil 1 is disposed in the passage wall 1*b* of the passage 5, for example.

Furthermore, the number of magnetic poles in the comb-shaped cores of the detecting coils 1 was four poles, but it is also possible to adopt a composition using two or more magnetic poles, for example.

What is claimed is:

1. A coin inspection method, comprising the steps of:

forming detecting coils by providing a first coil on one of two adjacent leg sections of a core having a plurality of leg sections and a second coil on the other one of the leg section respectively generating a double-peak shaped magnetic field by exciting the first and second coils in such a manner that magnetic fluxes generated at magnetic poles formed by the leg sections repel each other;

causing a coin under inspection to pass through the double-peak shaped magnetic field; and inspecting characteristics of the coin under inspection on the basis of changes in electrical properties of the detecting coils generated by the passage of the coin under inspection.

2. The coin inspection method according to claim 1, wherein the detecting coils allows the coin under inspection to pass through a direction coincide with a disposing direction of the first and second coils of the core.

3. The coin inspection method according to claim 1, wherein an inspection signal is created on the basis of changes in the electrical properties generated in the detecting coils, and features of edge portions of the coin under inspection are extracted on the basis of a signal waveform of the inspection signal when the waveform increases or declines.

4. The coin inspection method according to claim 1, wherein an inspection signal is created on the basis of changes in electrical properties generated in the detecting coils, and features of a pattern of indentations on a surface of the coin under inspection are extracted on the basis of a signal in a maximum change region of the inspection signal.

5. A coin inspection method, comprising the steps of:

disposing a first and second detecting coils, which are respectively provided with a first coil on one of two adjacent leg sections of a core having a plurality of leg sections and a second coil on the other one of the leg section, on either side of a coin passage along which a coin under inspection passes, the first and second detecting coils being connected serially in reverse phase in such a manner that a mutual inductance thereof is negative;

generating a double-peak shaped magnetic field toward the coin passage from the first and second detecting coils;

causing the coin under inspection to pass through the double-peak shaped magnetic field; and inspecting characteristics of the coin under inspection on the basis of changes in electrical properties of the detecting coils generated by the passage of the coin under inspection.

6. A coin inspection device for passing a coin under inspection through a magnetic field generated by detecting coils and determining authenticity of the coin under inspection on the basis of changes in electrical properties of the detecting coils, wherein the detecting coils comprise:

a core having a plurality of leg sections;

a first coil and a second coil provided respectively at two adjacent leg sections of the core; and magnetic field generating means for generating a double-peak shaped magnetic field by exciting the first coil and the second coil in such a manner that magnetic fluxes generated at magnetic poles formed by the two leg sections repel with each other.

7. The coin inspection device according to claim 6, wherein the core is constituted such that a cross-sectional shape of the leg sections is a square shape.

8. The coin inspection device according to claim 6, wherein the core is constituted such that a cross-sectional shape of the leg sections is a circular shape.

9. The coin inspection device according to claim 6, wherein the core is constituted such that a cross-sectional shape of the leg sections is an oval shape.

10. The coin inspection device according to claim 6, wherein the core is constituted such that both ends thereof are arc-shaped.

11. The coin inspection device according to claim 6, wherein the detecting coils are disposed in such a manner that a direction in which the first detecting coil and second detecting coil are disposed in the core coincides with a direction of passage of the coin under inspection.

12. The coin inspection device according to claim 6, comprising an oscillating circuit containing the detecting coils as a resonance element.

13. The coin inspection device according to claim 6, comprising inspection signal generating means for generating an inspection signal on the basis of changes in electrical properties generated in the detecting coils; and means for extracting features of edge portions of the coin under inspection on the basis of the inspection signal when it increases or declines.

14. The coin inspection device according to claim 6, comprising inspection signal generating means for generating an inspection signal on the basis of changes in electrical properties generated in the detecting coils; and means for extracting features of a pattern of indentations on a surface of the coin under inspection on the basis of a signal in a maximum change region of the inspection signal.

15. A coin inspection device for passing a coin under inspection through a magnetic field generated by detecting coils and determining authenticity of the coin under inspection on the basis of changes in electrical properties of the detecting coils, wherein the detecting coils comprise:

a first detecting coil disposed along a passage of the coin under inspection, and provided in a core having a plurality of leg sections which generates a first double-peak shape magnetic field toward the coin passage; and a second detecting coil disposed along the coin passage in such a manner as to oppose to the first detecting coil and provided on a core having a plurality of leg sections which generates a second double-peak shaped magnetic field toward the coin passage.

16. The coin inspection device according to claim 15, wherein the first and second detecting coils are disposed in such a manner that a disposing direction of the plurality of leg sections of the core coincides with a direction of passage of the coin under inspection.

17. The coin inspection device according to claim 15, wherein the first and second detecting coils are connected serially in reverse phase, in such a manner that a mutual inductance thereof is negative.

18. A coin inspection device for examining physical properties of a coin and inspecting authenticity of the coin, comprising:

a coin insertion slot;

a coin passage coupled to the coin insertion slot;

a first detecting coil disposed along the coin passage and generating a first double-peak shaped magnetic field toward the coin passage;

a second detecting coil disposed opposing the first detecting coil on the other side of the coin passage therefrom and generating a second double-peak shaped magnetic field toward the coin;

an oscillating circuit comprising the first and second detecting coil as a resonance element;

a detection circuit for detecting changes in electrical properties of the first and second detecting coils on the basis of an output of the oscillating circuit;

storing means for storing reference values for acceptable coins;

comparing means for comparing a detection output of the detection circuit with the reference values stored in the storing means; and determining means for determining authenticity of the coin inserted via the coin insertion slot, on the basis of a comparison output of the comparing means.

19. The coin inspection device according to claim 18, wherein the first and second detecting coils respectively comprise:

a core having a plurality of leg sections;

first and second coils provided respectively on two adjacent leg sections of the core; and magnetic field generating means for generating a double-peak shaped magnetic field by exciting the first and second coils in such a manner that magnetic fluxes generated by magnetic poles formed by the two leg sections repel with each other.

20. The coin inspection device according to claim 18, wherein the first and second detecting coils are disposed in such a manner that a disposing direction of the plurality of leg sections of the core coincides with a direction of passage of the coin under inspection.

21. The coin inspection device according to claim 18, wherein the first and second detecting coils are connected serially in reverse phase, in such a manner that a mutual inductance thereof is negative.

* * * * *